United States Patent [19]

Riederer et al.

[11] 4,223,719

[45] Sep. 23, 1980

[54] ROLLER APRON FOR A CONTINUOUS CASTING INSTALLATION

[75] Inventors: Hans Riederer, Maienfeld; Adolf Fuchs, Wädenswil, both of Switzerland; Raymond Vial, Lorette, France

[73] Assignee: Concast AG, Zürich, Switzerland

[21] Appl. No.: 855,165

[22] Filed: Nov. 28, 1977

[30] Foreign Application Priority Data

Dec. 8, 1976 [FR] France ..... 76 36930
Mar. 15, 1977 [CH] Switzerland ..... 3191/77

[51] Int. Cl.³ ..... B22D 11/12

[52] U.S. Cl. ..... 164/448; 72/245; 164/442

[58] Field of Search ..... 164/442, 448, 82, 270, 164/425; 29/129; 226/189, 176, 177; 72/3, 4, 245

[56] References Cited

U.S. PATENT DOCUMENTS

| | | | |
|---|---|---|---|
| 3,757,848 | 9/1976 | Scholz et al. | 164/448 |
| 3,946,798 | 3/1976 | Uchimoto et al. | 164/448 |
| 3,963,069 | 6/1976 | Marti et al. | 164/448 |
| 4,007,822 | 2/1977 | Scheurecker | 164/448 |
| 4,058,154 | 11/1977 | Streubel et al. | 164/82 |

*Primary Examiner*—Richard B. Lazarus
*Assistant Examiner*—John S. Brown
*Attorney, Agent, or Firm*—Werner W. Kleeman

[57] ABSTRACT

A roller apron for a continuous casting installation, especially for casting steel strands, for supporting a partially solidified strand, which comprises a number of successive pairs of rolls which follow one another in the direction of travel of the strand. The bearings of at least one roll are arranged at a traverse or crosshead extending essentially parallel to the lengthwise axes of the rolls. The traverse can be applied against stops governing the format or cross-sectional thickness of the strand and coacting at both ends with pivotable levers articulated at the machine frame and at a movement device. The movement device comprises a power source interconnecting both of the pivotable levers. This power source applies at both pivotable levers force components which are effective essentially parallel to the roll axes and thus applies the traverse elastically against the stops in the direction of the strand and also allows the traverse to automatically move away from the stops in the presence of a predetermined load limit associated with the traverse.

17 Claims, 7 Drawing Figures

Fig.1
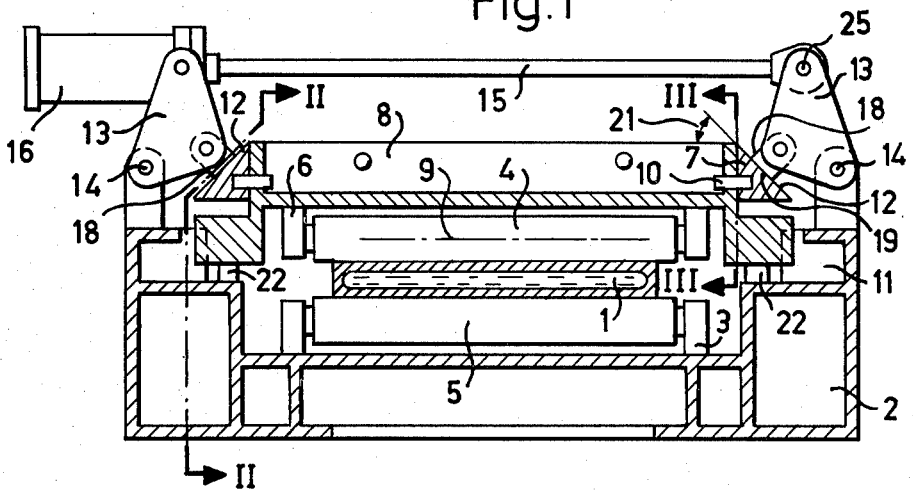
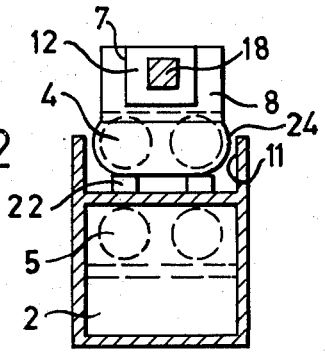
Fig. 2
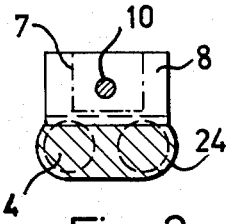
Fig. 3
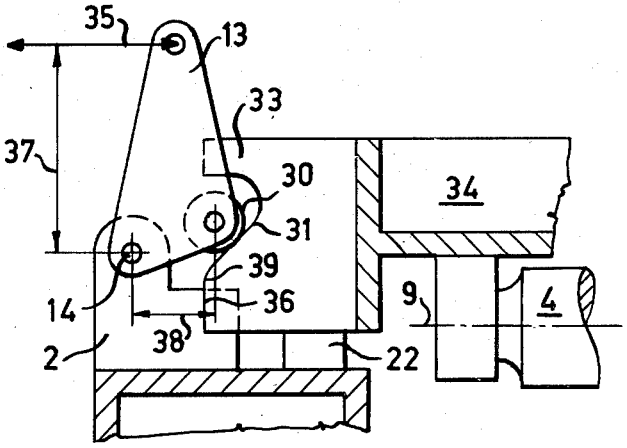
Fig. 4

ROLLER APRON FOR A CONTINUOUS CASTING INSTALLATION

BACKGROUND OF THE INVENTION

The present invention relates to a new and improved construction of a roller apron or strand guide arrangement for a continuous casting plant or installation, especially for casting steel, for supporting a partially solidified casting or strand, which roller apron is of the type comprising a number of roll pairs which follow one another in succession in the direction of strand travel, the bearings of at least one roll being arranged upon a crosshead or traverse extending essentially parallel to the lengthwise axes of the rolls. This traverse can be placed against stops or impact members which govern the strand cross-sectional thickness or format and coacts at both of its ends with pivotable levers articulated at the machine frame and at a movement device.

During the continuous casting of steel strands, especially slabs, considerable demands are made of the strand guide rolls, bending rolls and driving rolls during the casting operation, as concerns strength, bending-through, resistance to temperature changes, wear and so forth. When disturbances arise, for instance metal break-out, as a general rule the slabs only can be conveyed out of the roller apron at an appreciably lower temperature and in an essentially solidified state. When this happens such rolls are frequently loaded beyond their contemplated load limit. Oftentimes what then happens is that such rolls bend or rupture.

In order to increase the operational time of continuous casting installations it is not uncommon to exchange strand guide elements and/or individual rolls during the course of the normal preventive maintenance work. It is of course particularly important that such maintenance work be carried out in the shortest amount of time. Furthermore, in the presence of a disturbance it is of significance to be able to exchange defective rolls as quickly as possible.

Now it is known to apply guide rolls, bending rolls and driving rolls hydraulically against the surface of the strand in the manner such that upon overloading of a roll by the strand such can deviate in a direction away from the strand. During the assembly and disassembly of such rolls, depending upon the construction of the roll framework, either the hydraulic cylinder coacting with the roll bearings must be removed together with the roll, or, pressure transmission elements which are connected with the traverse or crosshead carrying the rolls must be disconnected from such traverses. Both of the aforementioned constructions require complicated and as a general rule poorly accessible dismantling work. Moreover, hydraulic overload safety devices for strand guide rolls of slab casting machines of the prior art continuous casting plants generally require at least one respective hydraulic cylinder at each side of the strand and, thus, are associated with high fabrication costs of the installation.

There is also known to the art a roller apron framework where bearings of a number of rolls of a roller guide path, which rolls follow one another in succession in the direction of strand travel, are arranged upon traverses or crossheads extending parallel to the lengthwise axes of the rolls. Such traverses can be applied against stops or impact members which govern the thickness of the strand. At both of their ends these traverses or crossheads have support surfaces which cooperate with pivotable levers articulated to both sides of the frame. These pivotable levers, for the purpose of pivoting or rocking the same, are connected with movement devices in the form of spindles. With this equipment there should be prevented movement of the rolls during the casting operation in a direction transversely with respect to the guided strand surface. Furthermore, there are provided devices which do not transmit the forces acting from the strand upon the rolls to the movement devices. An overload protection is not provided for these rolls. Consequently, there cannot be eliminated undesirable bending of the rolls, roll rupture and destruction of the roll bearings due to overload.

SUMMARY OF THE INVENTION

Hence, with the foregoing in mind it is a primary object of the present invention to provide a new and improved construction of roller apron for a continuous casting plant which is not associated with the aforementioned drawbacks and limitations of the prior art equipment.

Another and more specific object of the present invention aims at the provision of a new and improved construction of roller apron or strand guide arrangement which provides an automatically effective overload protection for the rolls of the roller apron, possesses a simple and economical construction, requires at most one power source for each supported roll and at the same time renders possible simple assembly and disassembly of the rolls of the roller apron.

Now in order to implement these and still further objects of the invention which will become more readily apparent as the description proceeds, the invention contemplates that the movement device comprises a power source which operatively interconnects both of the pivotable levers. This power source applies force components effective at both pivotable levers essentially parallel to the roll axes and thus advances the traverse elastically against the stops in the direction of the strand and enables the traverse to automatically move away from the stops when there is encountered a predetermined load limit correlated for the traverse.

The roller apron of the present invention solves the combined objectives noted above in a most advantageous manner. There is ensured protection of the rolls against overload, resulting in lesser roll wear, a more exact guiding of the strand with corresponding improvement in the quality of the cast product and lower maintenance costs. Furthermore, there is guaranteed a rational and simple dismantling and mounting of the rolls, because the pressure cylinders remain connected with the related pivotable levers and there is no necessity for dismantling or disconnecting associated lines or conduits for the pressurized medium delivered to the pressure cylinders. These advantages in turn allow for appreciably shortening the maintenance work at the continuous casting plant. The simple and cost-favorable construction of the roller apron of the invention also allows using an appreciably lower number of power sources and therefore equally a corresponding lesser number of infeed and withdrawal lines.

The pivotal or pivotable levers can be operatively connected in different ways with the traverse or crosshead. One advantageous solution contemplates articulating both of the pivotal levers with the traverse by means of bolts or equivalent structure.

A further construction providing an operative connection between the pivotable levers and the traverse is realized in accordance with another aspect of the invention in that the traverse is equipped with sliding surfaces inclined in relation to the lengthwise axis of the rolls and contact or press surfaces at the pivotable levers coact with the sliding surfaces.

The angle between the inclined sliding surfaces at the traverses and the lengthwise axes of the rolls is freely selectable. A particularly advantageous solution in respect of the force triangle which is produced by such angle for the contact force of the elastically effective power source is obtained if the inclined slide surfaces form an angle of 45° with respect to the lengthwise axes of the rolls.

The frictional resistance between the contact surfaces and sliding surfaces can be reduced and at the same time there can be further simplified the construction of the pivotable lever if these pivotable levers are equipped with contact or pressure rolls.

With certain operating conditions such as for instance when conveying out cooled, curved cast pieces at curved-type continuous casting plants, it can be necessary to open both of the oppositely situated strand guide paths by for instance 200 to 500 millimeters. To enable such opening of the strand paths by means of the available devices such as pivotable levers, traverses and contact or pressure rolls, it is recommended according to the invention to equip the traverse following the inclined sliding surfaces with hook-like projections.

When working with traverses or crossheads which carry two or more rolls, tilting movements of the traverses cannot be avoided. During such tilting movements of the traverses, the inclined sliding surfaces, associated with the traverses, also tilt or rock. In order to be able to maintain essentially constant the surface compression between the sliding surfaces at the traverses and the contact or pressure surfaces of the pivotable levers also when the traverse is tilted, the invention further proposes providing the inclined sliding surfaces at slide shoes which are hingedly connected at the traverse by means of pivot shafts or axes arranged parallel to the lengthwise axis of the rolls.

The lift height or elevational stroke of the traverse transversely of the lengthwise axis of the rolls is limited by the length of the stroke of the power source. In the presence of a disturbance at the installation it can be of advantage if, for instance, there is possible a deviation of the rolls away from the strand through 100 millimeters and more without there being required dismantling work or the use of power sources having correspondingly long strokes. According to a further feature of the invention this can be advantageously obtained if additional sliding surfaces which extend transversely with respect to the lengthwise axes of the rolls merge at the inclined sliding surfaces.

A further construction for realizing an operative connection between the pivotable levers and the traverse or crosshead is proposed in accordance with an additional feature of the invention which contemplates providing the pivotable levers with contact or pressure bodies which coact with essentially horizontally arranged support surfaces provided at the traverse.

An advantageous solution recommended by the invention is to provide the pivotable levers with spherical or cylindrical contact or pressure bodies. In order to however maintain low the surface compression at the pressure surfaces and sliding surfaces, it can be advantageous to equip the pivotable levers with supports articulated thereat and having Cardan mounted contact or pressure bodies.

The requisite force of the elastically effective power source for supporting, bending, straightening and driving the cast strand can be reduced according to a further aspect of the invention if the effective lever arm of the pivotable lever between the point of articulation at the frame and its contact at the traverse is smaller than the effective lever arm between the point of articulation at the frame and the articulation at the power source. Due to these measures, especially when casting wide slab shapes, it is possible to further reduce the costs of the roller apron. Alos this measure enables the use of smaller force or power applying devices or, for instance, lower hydraulic pressures as are required, for instance, when using a water hydraulic system.

As the power source there can be employed, for instance, any elastically effective buffer or dampening device such as for instance cylinders filled with an elastic mass, spring packages and so forth. There can advantageously be employed as the power source a pressure cylinder. In order to avoid losses of the pressurized medium when working with hydraulic oil systems, there can be employed, for instance, a hydraulic system controlled by pressurized or compressed air and equipped with a pressure converter.

The horizontal mounting of heavy hydraulic cylinders can exert upon sealing gaskets or packing glands, sealing the cylinder chamber in relation to the piston rod, an irregular pressure over the periphery of the gasket and thus can produce uneven or irregular wear at the gaskets and piston rods. These drawbacks can be eliminated if the pressure cylinder is hingedly connected approximately at its center of gravity at the pivotable lever.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a vertical sectional view through a roller apron or strand guide arrangement constructed according to the teachings of the present invention;

FIG. 2 is a cross-sectional view, taken substantially along the line II—II of FIG. 1;

FIG. 3 is a cross-sectional view, taken substantially along the line III—III of FIG. 1;

FIG. 4 is a fragmentary vertical sectional view of a further embodiment of roller apron;

DETAILED DESCRIPTION OF THE PREFERRED EMBODIMENTS

Figure 5:
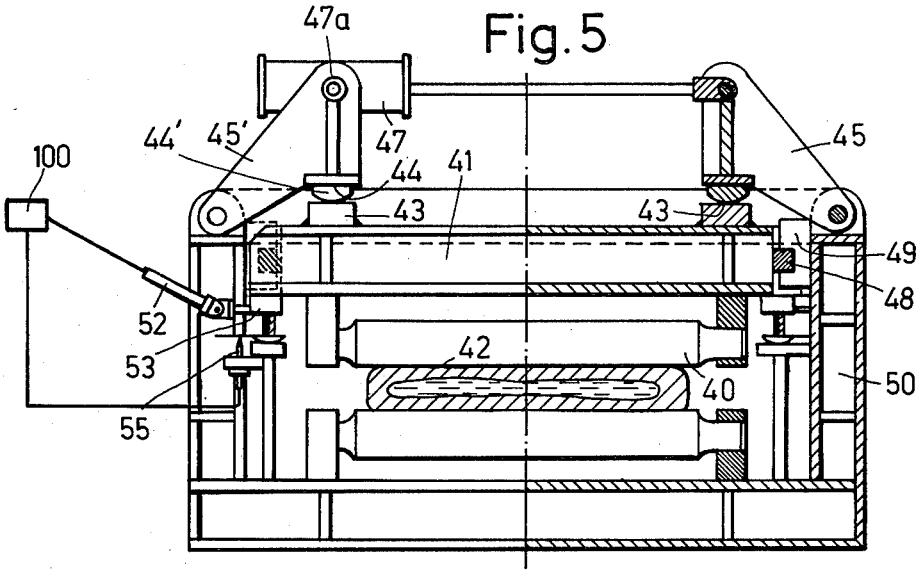
FIG. 5 is an elevational view, partially in section, of a further embodiment of roller apron according to the present invention.

Describing now the drawings, in FIGS. 1 to 3 reference character 1 illustrates a partially solidified casting, here shown in the form of a slab dispositioned within a roller apron or strand guide arrangement of a continuous casting plant or installation, especially for casting steel. Secured to a machine frame or stand 2 by means of bearings 3 are the lower rollers or rolls 5. It is also however possible, for instance, for these lower rolls 5 to be supported upon the machine frame 2 by means of pressure cylinders e.g. fluid-operated piston-and-cylinder units, if there is desired an elastic roll supporting arrangement. At the upper surface or side of the strand 1 the rolls or rollers 4 are connected with a traverse or crosshead 8 by means of the bearings 6. Traverse 8 extends essentially parallel to the lengthwise axis of each of such rolls 4. In continuous casting plants producing extremely wide cast slabs the rolls 5 and 4 also can be supported at the machine frame 2 and the traverse 8 respectively, with the aid of three or more bearings. The traverse 8 is movable at the frame or stand 2 along guides or guide means 11 arranged transversely with respect to the incoming surface of the casting or strand 1. At both ends of the traverse 8 there are provided inclined slide or sliding surfaces 12 at the slide shoes or pressure pads 7. These sliding surfaces 12 are operatively associated with the pivotable levers or lever members 13 which, in turn, are articulated by means of bolts 14 or other suitable equivalent structure at the machine frame 2. Both of the pivotable levers 13 which coact with the traverse or crosshead 8 are connected by means of a tie rod or traction element 15 with a movement device which, in the embodiment under discussion, comprises a power source or force-applying source 16 in the form of a piston-and-cylinder unit. The power source 16 interconnects both of the pivotable levers 13 and applies thereto a force component which is effective essentially parallel to the lengthwise axes 9 of the rolls 4. The pivotable or pivotal levers 13 are equipped with a respective hingedly connected support 18, the pressure or contact surfaces 19 of which cooperate with the sliding surfaces 12 of the traverse 8. The inclined sliding surfaces 12 are arranged at an angle 21 of approximately 45° with respect to the lengthwise axes 9 of the rolls 4. The sliding shoes or pressure pads 7 are articulated at the traverse 8 by means of pivots or swivel pins 10 arranged parallel to the roll-lengthwise axes 9. This articulated connection permits an automatic adjustment of the sliding shoes 7 upon the pressure or contact surfaces 19 whenever the traverse 8 carries out a tilting motion upon overloading of only one of the rolls 4.

Having now had the benefit of the foregoing discussion there will be considered the function of such roller apron which is as follows:

The traverse 8 is elastically applied against stops 22 in the direction of the strand 1 by the action of the power source 16 through the agency of the pivotable levers 13 and the supports 18 for controlling the cross-sectional thickness of the cast strand. The force produced at the power source 16 is calculated such that the ferrostatic pressure of the liquid core of the strand 1 can be supported. If in the presence of a disturbance at the continuous casting plant, such as for instance during the outfeed of a completely solidified strand, greater forces are applied from the strand to the rolls 4 and in turn the traverse 8, then, the power source 16 permits an automatic movement when encountering a predetermined load limit which is correlated with or contemplated for the traverse 8. As a result, while rocking of the pivotable levers 13 about the pivot pins or bolts 14, the supports 18 slide along the inclined sliding or contact surfaces 12. The traverse 8 is therefore lifted away from the stops or impact members 22. The rolls 4 are thus protected against overload. After diminishing of the overload the traverse 8 again rests upon the stops or impact members 22. As best seen by referring to FIG. 2, there are arranged two rolls 4 at the traverse 8. By appropriately constructing the guide surfaces 24 at the traverse 8 which coact with the guides or guide means 11 there is rendered possible tilting of the traverse 8, so that each of both rolls 4 themselves can lift-off of the related or associated stop or impact members 22.

In order to disassemble the rolls 4 and 5 both of the pivotable levers 13 are rocked towards the outside by the power source 16. A bolt 25 or equivalent structure is removed in order that the tie rod or connection element 15 can be brought into an approximately vertical position. The traverse 8 now is free and thus can be raised out of the roller apron by means of any suitable lifting device, such as a crane for instance. Thereafter, if desired, the lower rolls 5 can be dismantled. The assembly work can be accomplished in the reverse sequence.

In FIG. 4 there is shown a traverse or crosshead 34 having only a single roll or roller 4. Instead of support 18 there is arranged a contact or pressure roll 30 at the pivotable lever 13. Moreover, this traverse 34 is provided with substantially hook-like projections 33 following the inclined slide or sliding surfaces 31, which projections enable engagement of the contact or pressure rolls 30 and upon rocking of the pivotable levers 13 lifting of such traverse 34. The double-headed arrow 35 located to the left of the pivotable lever 13 of the showing of FIG. 4 schematically designates the directions of movement of a double-acting piston-and-cylinder unit 16. If the pivotable lever 13 is rocked towards the left of FIG. 4 about the pivot pin or pivot 14 articulated at the machine frame, then the contact roll 30 engages into the hook-like projection 33 and lifts the traverse 34. Upon rocking of the pivotable lever 13 towards the right the traverse is lowered onto the stop or impact member 22.

Merging with the sliding surfaces 31 are the additional slide or sliding surfaces 36 which extend transversely with respect to the lengthwise axis 9 of the roll 4. If the traverse 34 is sufficiently raised from the stop or impact member 22, for instance due to deformation of the casting or strand, then the contact roll 30 slides past the rounded portion 39.

The depicted dimension lines portray the effective lengths 37 and 38 of the lever arms of the pivotable lever 13 between the hinge or articulation point 14 at the machine frame 2 and the piston-and-cylinder unit 35 and between the articulation point 14 at the machine frame 2 and the axis of contact roll 30, respectively. The force to be produced in the piston-and-cylinder unit 35 can be freely selected within limits governed by the construction by determining the relationship of the effective lengths 37 and 38 of the two lever arms, in oder to apply the contact force at the traverse 34 needed for a certain strand cross-sectional thickness or format.

There can be employed instead of a piston-and-cylinder unit, for instance, also a spring as the elastically effective power source 16. In order to compensate an applied force at the pivotable lever 13 which can be varied by a spring characteristic, each inclined slide surface 12 can be designed as a cam surface. In this way there also can be obtained with spring force a substantially uniform application or contact force at least over a first partial region of the approach path away from the stop 22.

In FIG. 5 there is illustrated a traverse 41 connected with one or more rolls 40 and having support surfaces 43 arranged essentially parallel to the guided strand surface 42. These support surfaces 43 cooperate with the contact or pressure bodies 44 which are attached at the pivotable levers 45. The contact bodies 44 possess curved contact surfaces 44', here shown as substantially spherically-shaped contact or pressure surfaces. They can be however also constructed to have a cylindrical surface, and thus, contact surfaces 44' can be conceptually viewed as being of essentially cylindrical shape. It is equally conceivable for the support surface 43 to be essentially spherical-shaped and that the contact or pressure body 44 has a flat or planar contact surface.

A pressure cylinder unit 47 is mounted at the region of its center of gravity, generally indicated at location 47*a*, at the pivotable lever 45'. The traverse 41 is provided at both ends with a respective guide or guide means 48 which can slide along guide tracks or guideways 49 provided at the machine frame 50, these guide tracks 49 being disposed transversely with respect to the guide strand or casting surface 42. For the remote-controlled strand format or cross-sectional thickness adjustment the roller apron is equipped with an electrical adjustment drive, indicated by reference character 100, which drives a Cardan shaft 52 by means of worm gearing 53 cooperating with an adjustment screw. To control the adjustment drive 100 and for the exact control of the position of the traverse 41 there is provided an inductive position detector or transmitter 55.

Figure 6:
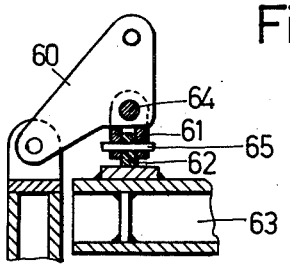
FIG. 6 is a fragmentary vertical sectional view of a further construction.

In FIG. 6 there is illustrated a contact or pressure body 62 which is operatively associated with a traverse 63. By means of both bolts 64 and 65 or equivalent structure the contact body 62 is articulated in a cardanic or gimbal-like manner by means of a support 61 at its associated pivotable lever 60.

Figure 7:
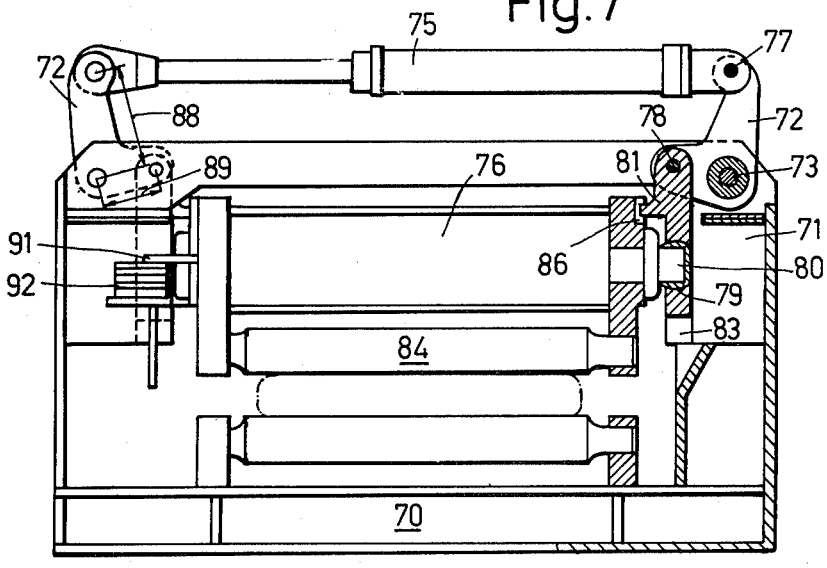
FIG. 7 illustrates a further embodiment in elevational view, partly in section, of a roller apron of the present invention.

Now in FIG. 7 pivotable levers 72 are hingedly connected by bolts 73 or equivalent pivots to columns 71 arranged at both ends of a machine frame 70. A power source 75 i.e. force-applying device and guides or links 81 are connected by means of bolts 77 and 78, respectively, with the pivotable levers 72. The guides 81 are connected at both ends of a traverse or crosshead 76 by means of a spherical bearing 79 and journals 80 with the traverse 76. The guides 81 are guided at the guide surfaces 83 of the columns 71. Now if the traverse 76 is equipped, for instance, with four rolls 84 which follow one another in succession in the direction of travel of the strand, then there is possible a tilting movement of the traverse or crosshead 76 about the journals or bearing pins 80. By means of stops or impact members 86, which coact with the guides 81, it is possible to limit the tilting movement of the traverse 76 to a desired extent.

The relationship of the lengths 88 and 89 of the lever arms to one another provides a mechanical advantage for the contact force produced by the power source or force-applying device 75. By means of the increased force obtained by the mechanical advantage the support surfaces 91 of the traverse 76 are applied against exchangeable stops or impact members 92.

The proposed roller apron can be advantageously employed both at the secondary cooling zone of a strand guide arrangement of a continuous casting plant as well as also at the driving, bending and straightening assemblies.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. Roller apron for a continuous casting plant for supporting a partially solidified cast strand, especially a steel strand, comprising:

a rigid machine frame;

a plurality of pairs of rolls which follow one another in succession in the direction of travel of the cast strand;

a traverse;

bearings for rotatably mounting the rolls;

the bearings of at least one roll being arranged upon said traverse;

said traverse extending essentially parallel to the lengthwise axis of said at least one roll supported thereby;

stop means cooperating with the traverse for governing the cross-sectional thickness of the cast strand;

means for applying the traverse against said stop means;

said applying means comprising first and second pivotable levers cooperating with a respective opposite end of the traverse;

a movement device;

each pivotable lever being hingedly connected directly at both said rigid machine frame and said movement device;

said movement device comprising a power source interconnecting both of the pivotable levers with one another;

said power source applying force components effective essentially parallel to the lengthwise axes of the rolls at both pivotable levers and thus applying the traverse elastically against said stop means in the direction of the cast strand and enabling said traverse to automatically move away from said stop means when subjected to a predetermined load limit correlated for said traverse.

2. The roller apron as defined in claim 1, further including:

bolt means for hingedly connecting the pivotable levers with the traverse.

3. The roller apron defined in claim 1, wherein:

said traverse is equipped with sliding surfaces inclined in relation to the lengthwise axis of the roll supported thereby;

said pivotable levers having contact surfaces coacting with said sliding surfaces.

4. The roller apron as defined in claim 3, wherein:

said inclined sliding surfaces enclose an angle of about 45° with respect to said lengthwise axis of the roll.

5. Roller apron for a continuous casting plant for supporting a partially solidified cast strand, especially a steel strand, comprising:

a rigid machine frame;

a plurality of pairs of rolls which follow one another in succession in the direction of travel of the cast strand;

a traverse;

bearings for rotatably mounting the rolls;

the bearings of at least one roll being arranged upon said traverse;

said traverse extending essentially parallel to the lengthwise axis of said at least one roll supported thereby;

stop means cooperating with the traverse for governing the cross-sectional thickness of the cast strand;
means for applying the traverse against said stop means;
said applying means comprising first and second pivotable levers cooperating with a respective opposite end of the traverse;
a movement device;
each pivotable lever being hingedly connected to the rigid machine frame and to said movement device;
said movement device comprising a power source interconnecting both of the pivotable levers with one another;
said power source applying force components effective essentially parallel to the lengthwise axes of the rolls at both pivotable levers and thus applying the traverse elastically against said stop means in the direction of the cast strand and enabling said traverse to automatically move away from said stop means when subjected to a predetermined load limit correlated for said traverse;
said traverse being equipped with sliding surfaces inclined in relation to the lengthwise axis of the roll supported thereby;
said pivotable levers having contact surfaces coacting with said sliding surfaces; and
said pivotable levers being provided with contact rolls.

6. Roller apron for a continuous casting plant for supporting a partially solidified cast strand, especially a steel strand, comprising:
a rigid machine frame;
a plurality of pairs of rolls which follow one another in succession in the direction of travel of the cast strand;
a traverse;
bearings for rotatably mounting the rolls;
the bearings of at least one roll being arranged upon said traverse;
said traverse extending essentially parallel to the lengthwise axis of said at least one roll supported thereby;
stop means cooperating with the traverse for governing the cross-sectional thickness of the cast strand;
means for applying the traverse against said stop means;
said applying means comprising first and second pivotable levers cooperating with a respective opposite end of the traverse;
a movement device;
each pivotable lever being hingedly connected to the rigid machine frame and to said movement device;
said movement device comprising a power source interconnecting both of the pivotable levers with one another;
said power source applying force components effective essentially parallel to the lengthwise axes of the rolls at both pivotable levers and thus applying the traverse elastically against said stop means in the direction of the cast strand and enabling said traverse to automatically move away from said stop means when subjected to a predetermined load limit correlated for said traverse;
said traverse being equipped with sliding surfaces inclined in relation to the lengthwise axis of the roll supported thereby;
said pivotable levers having contact surfaces coacting with said sliding surfaces; and
said traverse being provided with substantially hook-like projections following the inclined sliding surfaces.

7. The roller apron as defined in claim 3, wherein:
said inclined sliding surfaces are provided at sliding shoes;
pivot means for articulating said sliding shoes at said traverse;
said pivot means being arranged essentially parallel to said lengthwise axis of the roll.

8. Roller apron for a continuous casting plant for supporting a partially solidified cast strand, especially a steel strand, comprising:
a rigid machine frame;
a plurality of pairs of rolls which follow one another in succession in the direction of travel of the cast strand;
a traverse;
bearings for rotatably mounting the rolls;
the bearings of at least one roll being arranged upon said traverse;
said traverse extending essentially parallel to the lengthwise axis of said at least one roll supported thereby;
stop means cooperating with the traverse for governing the cross-sectional thickness of the cast strand;
means for applying the traverse against said stop means;
said applying means comprising first and second pivotable levers cooperating with a respective opposite end of the traverse;
a movement device;
each pivotable lever being hingedly connected to the rigid machine frame and to said movement device;
said movement device comprising a power source interconnecting both of the pivotable levers with one another;
said power source applying force components effective essentially parallel to the lengthwise axes of the rolls at both pivotable levers and thus applying the traverse elastically against said stop means in the direction of the cast strand and enabling said traverse to automatically move away from said stop means when subjected to a predetermined load limit correlated for said traverse;
said traverse being equipped with sliding surfaces inclined in relation to the lengthwise axis of the roll supported thereby;
said pivotable levers having contact surfaces coacting with said sliding surfaces; and
additional sliding surfaces merging with the inclined sliding surfaces;
said additional sliding surfaces extending substantially transversely with respect to said lengthwise axis of the roll.

9. The roller apron as defined in claim 1, wherein:
said pivotable levers are provided with contact bodies;
said traverse being provided with support surfaces arranged essentially parallel to the guided surface of the cast strand;
said contact bodies cooperating with said support surfaces.

10. Roller apron for a continuous casting plant for supporting a partially solidified cast strand, especially a steel strand, comprising:
a machine frame;

a plurality of pairs of rolls which follow one another in succession in the direction of travel of the cast strand;
a traverse;
bearings for rotatably mounting the rolls;
the bearings of at least one roll being arranged upon said traverse;
said traverse extending essentially parallel to the lengthwise axis of said at least one roll supported thereby;
stop means cooperating with the traverse for governing the cross-sectional thickness of the cast strand;
means for applying the traverse against said stop means;
said applying means comprising first and second pivotable levers cooperating with a respective opposite end of the traverse;
a movement device;
each pivotable lever being hingedly connected to the machine frame and to said movement device;
said movement device comprising a power source interconnecting both of the pivotable levers with one another;
said power source applying force components effective essentially parallel to the lengthwise axes of the rolls at both pivotable levers and thus applying the traverse elastically against said stop means in the direction of the cast strand and enabling said traverse to automatically move away from said stop means when subjected to a predetermined load limit correlated for said traverse;
said pivotable levers being provided with contact bodies;
said traverse being provided with support surfaces arranged essentially parallel to the guided surface of the cast strand;
said contact bodies cooperating with said support surfaces;
means for providing a Cardan-type hinge connection of said contact bodies at said pivotable levers; and
said contact bodies having contact surfaces.

11. Roller apron for a continuous casting plant for supporting a partially solidified cast strand, especially a steel strand, comprising:
a machine frame;
a plurality of pairs of rolls which follow one another in succession in the direction of travel of the cast strand;
a traverse;
bearings for rotatably mounting the rolls;
the bearings of at least one roll being arranged upon said traverse;
said traverse extending essentially parallel to the lengthwise axis of said at least one roll supported thereby;
stop means cooperating with the traverse for governing the cross-sectional thickness of the cast strand;
means for applying the traverse against said stop means;
said applying means comprising first and second pivotable levers cooperating with a respective opposite end of the traverse;
a movement device;
each pivotable lever being hingedly connected to the machine frame and to said movement device;
said movement device comprising a power source interconnecting both of the pivotable levers with one another;
said power source applying force components effective essentially parallel to the lengthwise axes of the rolls at both pivotable levers and thus applying the traverse elastically against said stop means in the direction of the cast strand and enabling said traverse to automatically move away from said stop means when subjected to a predetermined load limit correlated for said traverse; and
each of said pivotable levers having an effective lever arm length between its point of articulation at the machine frame and its contact at the traverse which is smaller than the effective length of the lever arm between its point of articulation at the machine frame and its point of articulation at the power source.

12. The roller apron as defined in claim 11, further including:
means for articulating said piston-and-cylinder arrangement approximately at its center of gravity at an associated pivotable lever.

13. The roller apron as defined in claim 11, wherein:
said power source comprises a pressurized fluidoperated piston-and-cylinder arrangement.

14. Roller apron for a continuous casting plant for supporting a partially solidified cast strand, comprising:
a rigid machine frame;
a plurality of pairs of rolls which follow one another in succession in the direction of travel of the cast strand;
a traverse;
bearings for rotatably mounting the rolls;
the bearings of at least one roll being arranged upon said traverse;
said traverse extending essentially parallel to the lengthwise axis of said at least one roll supported thereby;
stop means cooperating with the traverse for governing the cross-sectional thickness of the cast strand;
means for applying the traverse against said stop means;
said applying means comprising pivotable levers cooperating with opposite ends of the traverse;
a movement device;
said pivotable levers being hingedly connected directly both the rigid machine frame and said movement device;
said movement device comprising a power source operatively interconnecting both of the pivotable levers with one another;
said power source applying force components effective essentially parallel to the lengthwise axis of said one roll at both pivotable levers and thus applying the traverse elastically against said stop means in the direction of the cast strand and enabling said traverse to automatically move away from said stop means when subjected to a predetermined load limit contemplated for said traverse.

15. Roller apron for a continuous casting plant for supporting a partially solidified cast strand, especially a steel strand, comprising:
a rigid machine frame;
a plurality of pairs of rolls which follow one another in succession in the direction of travel of the cast strand;
a traverse;
bearings for rotatably mounting the rolls;
the bearings of at least one roll being arranged upon said traverse;

said traverse extending essentially parallel to the lengthwise axis of said at least one roll supported thereby;

stop means cooperating with the traverse for governing the cross-sectional thickness of the cast strand;

means for applying the traverse against said stop means;

said applying means comprising first and second pivotable levers cooperating with a respective opposite end of the traverse;

a movement device;

each pivotable lever being hingedly connected to the rigid machine frame and to said movement device;

said movement device comprising a power source interconnecting both of the pivotable levers with one another;

said power source applying force components effective essentially parallel to the lengthwise axes of the rolls at both pivotable levers and thus applying the traverse elastically against said stop means in the direction of the cast strand and enabling said traverse to automatically move away from said stop means when subjected to a predetermined load limit correlated for said traverse;

said pivotable levers being provided with contact bodies;

said traverse being provided with support surfaces arranged essentially parallel to the guided surface of the cast strand;

said contact bodies cooperating with said support surfaces; and said pivotable levers being equipped with curved contact bodies.

16. Roller apron for a continuous casting plant for supporting a partially solidified cast strand, especially a steel strand, comprising:

a rigid machine frame;

a plurality of pairs of rolls which follow one another in succession in the direction of travel of the cast strand;

a traverse;

bearings for rotatably mounting the rolls;

the bearings of at least one roll being arranged upon said traverse;

said traverse extending essentially parallel to the lengthwise axis of said at least one roll supported thereby;

stop means cooperating with the traverse for governing the cross-sectional thickness of the cast strand;

means for applying the traverse against said stop means;

said applying means comprising first and second pivotable levers cooperating with a respective opposite end of the traverse;

a movement device;

each pivotable lever being hingedly connected to the rigid machine frame and to said movement device;

said movement device comprising a power source interconnecting both of the pivotable levers with one another;

said power source applying force components effective essentially parallel to the lengthwise axes of the rolls at both pivotable levers and thus applying the traverse elastically against said stop means in the direction of the cast strand and enabling said traverse to automatically move away from said stop means when subjected to a predetermined load limit correlated for said traverse;

said pivotable levers being provided with contact bodies;

said traverse being provided with support surfaces arranged essentially parallel to the guided surface of the cast strand;

said contact bodies cooperating with said support surfaces; and said contact bodies being substantially spherical-shaped.

17. Roller apron for a continuous casting plant for supporting a partially solidified cast strand, especially a steel strand, comprising:

a rigid machine frame;

a plurality of pairs of rolls which follow one another in succession in the direction of travel of the cast strand;

a traverse;

bearings for rotatably mounting the rolls;

the bearings of at least one roll being arranged upon said traverse;

said traverse extending essentially parallel to the lengthwise axis of said at least one roll supported thereby;

stop means cooperating with the traverse for governing the cross-sectional thickness of the cast strand;

means for applying the traverse against said stop means;

said applying means comprising first and second pivotable levers cooperating with a respective opposite end of the traverse;

a movement device;

each pivotable lever being hingedly connected to the rigid machine frame and to said movement device;

said movement device comprising a power source interconnecting both of the pivotable levers with one another;

said power source applying force components effective essentially parallel to the lengthwise axes of the rolls at both pivotable levers and thus applying the traverse elastically against said stop means in the direction of the cast strand and enabling said traverse to automatically move away from said stop means when subjected to a predetermined load limit correlated for said traverse;

said pivotable levers being provided with contact bodies;

said traverse being provided with support surfaces arranged essentially parallel to the guided surface of the cast strand; and said contact bodies being substantially cylindrical in shape.

* * * * *